US006062686A

United States Patent [19]

Kinoshita et al.

[11] Patent Number: 6,062,686

[45] Date of Patent: May 16, 2000

[54] HAND HELD INK JET PRINTER

[75] Inventors: Naohisa Kinoshita; Motoaki Yamanashi, both of Nagoya; Masatoshi Kokubo, Ama-gun; Yoshiki Katayama, Nagoya, all of Japan

[73] Assignee: Brother Kogyo Kabsushiki Kaisha, Nagoya, Japan

[21] Appl. No.: 08/733,183

[22] Filed: Oct. 17, 1996

[30] Foreign Application Priority Data

Oct. 25, 1995 [JP] Japan ..... 7-277684

[51] Int. Cl.[7] ..... B41J 3/36

[52] U.S. Cl. ..... 347/109; 400/88

[58] Field of Search ..... 347/109, 108, 347/222, 263, 152, 170, 5, 8; 346/143; 400/88

[56] References Cited

U.S. PATENT DOCUMENTS

| | | | |
|---|---|---|---|
| 4,412,232 | 10/1983 | Weber et al. | 347/109 |
| 4,441,817 | 4/1984 | Pryor | 356/375 |
| 4,901,164 | 2/1990 | Kurosawa . | |
| 4,949,283 | 8/1990 | Yamauchi et al. | 346/143 |
| 5,240,334 | 8/1993 | Epstein et al. | 400/88 |
| 5,593,236 | 1/1997 | Bobry . | |

FOREIGN PATENT DOCUMENTS 48-17630 6/1973 Japan .

*Primary Examiner*—N. Le
*Assistant Examiner*—Michael S. Brooke
*Attorney, Agent, or Firm*—Oliff & Berridge, PLC

[57] ABSTRACT

A manual printing device for printing on a surface of a recording medium when manually scanned in a scanning direction over the recording medium, the manual printing device including: an elongated body to be manually grasped by a user and having an upper tip and a lower tip opposite the upper tip, the lower tip confronting the recording medium when the body is oriented with respect to the recording medium to print on the recording medium; an ink jet print head disposed at the lower tip and capable of printing at a maximum printing width on the surface of the printing medium; a frame disposed at the lower tip and, with respect to the scanning direction, in front of the ink jet print head; a roller rotatably supported on the frame to rotate across the surface of the recording medium when the manual printing device is scanned in the scanning direction over the recording medium; and a protrusion extending from the frame and, when the body is oriented to print on the recording medium, into contact with the recording medium so as to maintain a predetermined distance between the ink jet print head and the recording medium.

21 Claims, 5 Drawing Sheets

HAND HELD INK JET PRINTER

BACKGROUND OF THE INVENTION

1. Field of the Invention

The present invention relates to a manual printing device manually held by a user to print characters and symbols across the surface of a printing medium such as a printing sheet.

2. Description of the Related Art

There has been known a manual printing device for printing on a desired area of a variety of printing mediums. For example, Japanese Patent Application (Kokai) SHO-48-17630 describes a manual printing device having a front and rear roller disposed at its base. A print head capable of printing in a predetermined width is disposed between the two rollers. To print on the surface of a recording medium using the print head, the manual printing device is scanned across the surface of a recording medium. The rollers support the print head in a fixed distance from the recording medium. The cylindrical rollers are formed longer than the predetermined printing width of the print head. So that the rear roller does not cross over freshly printed areas and smudge the freshly printed ink, a central portion of the rear roller, corresponding to the printing width, is formed with a narrower diameter than the rest of the rear roller. In this way, the portion of the rear roller corresponding to the printed area does not contact the printed area.

SUMMARY OF THE INVENTION

It is conceivable to use an ink jet type print head as the print means of the manual printing device. Not only would such a manual printing device be more compact, but also, an ink jet print head not need come into direct contact with the surface of the printing medium, so that users can easily confirm printed characters by viewing them through the space separating the print head from the printing medium.

However, because the front and rear rollers are formed longer than the maximum width of the print head, it is difficult to print more than one line without smudging characters. To print two successive lines, for example, after printing a first line, the manual printing device is shifted one line width's distance and then scanned in the scanning direction to print the second line. The rollers can smudge the ink of the first line of the characters while printing the characters of the second line. This would especially be a problem if the manual printing device were to include an ink jet type print head because ink does not instantaneously dry after printing.

Also, when the manual printing device is scanned in a direction opposite to the normal scanning direction, the front roller can roll back onto a freshly printed section, thereby smudging the printed characters of that section. To prevent the front roller from smudging characters in this manner, the front roller also must be formed with a smaller diameter at its portion that corresponds to the printing region. However, this makes it impossible to form the front and rear rollers shorter than the width of the maximum printing width.

It is an objective of the present invention to overcome the above-described problems and to provide a compact manual printing device capable of clean printing without the printed characters being smudged.

To achieve the above-described objectives, a manual printing device according to the present invention for printing on a surface of a recording medium when manually scanned in a scanning direction over the recording medium, includes: a printing means capable of printing at a maximum printing width on the surface of the printing medium; and positioning means provided at a front side of the printing means with respect to the scanning direction and having a contact portion for positioning the printing means with respect to the surface of the recording medium by contacting the surface of the recording medium.

With this configuration, the positioning means positions the print means with respect to the recording medium by contacting the recording medium. When the portion of the positioning means contacting the recording medium is formed narrower in a direction orthogonal to the scanning direction than the maximum printing width, which is also in a direction orthogonal to the scanning direction, then even if a second line is printed very close to where a first line is printed, the printed characters of the first line will not be smudged during printing of the second line.

According to another aspect of the present invention, the recording means includes an ink jet print head so that the manual printing device can be smaller and have a simple configuration than if the recording means included a wire dot type printing mechanism, which uses a print ribbon.

According to still another aspect of the present invention, the positioning means rotates across the surface of the recording medium to detect relative position between the recording medium and the print means. Therefore, the positioning means not only positions the manual printing device but also detects its position with regards to the printing medium. Since a single component performs two functions, the overall size of the manual printing device can be reduced.

According to a further aspect of the present invention, the supporting means maintains the manual printing device at a certain posture with respect to the recording medium so that the recording means can print more stably.

According to a still further aspect of the present invention, the prevention means prevents the recording means from printing when the manual printing device is scanned in a direction different from the scanning direction. Therefore, the positioning means will not smudge previously printed characters and the like.

In another aspect of the present invention a manual printing device includes: a printing means capable of printing at a maximum printing width on the surface of the printing medium; positioning means provided at a front side of the printing means with respect to the scanning direction and for positioning the printing means with respect to the surface of the recording medium by contacting the surface of the recording medium; and stop means for stopping printing operations of the printing means when the printing means is scanned in another direction different from the scanning direction.

According to still another aspect of the present invention, a manual printing device includes: an elongated body to be manually grasped by a user and having an upper tip and a lower tip opposite the upper tip, the lower tip confronting the recording medium when the body is oriented with respect to the recording medium to print on the recording medium; an ink jet print head disposed at the lower tip and capable of printing at a maximum printing width on the surface of the printing medium; a frame disposed at the lower tip and, with respect to the scanning direction, in front of the ink jet print head; a roller rotatably supported on the frame to rotate across the surface of the recording medium when the manual printing device is scanned in the scanning direction over the recording medium; and a protrusion extending from the frame and, when the body is oriented to print on the recording medium, into contact with the recording medium so as to maintain a predetermined distance between the ink jet print head and the recording medium.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
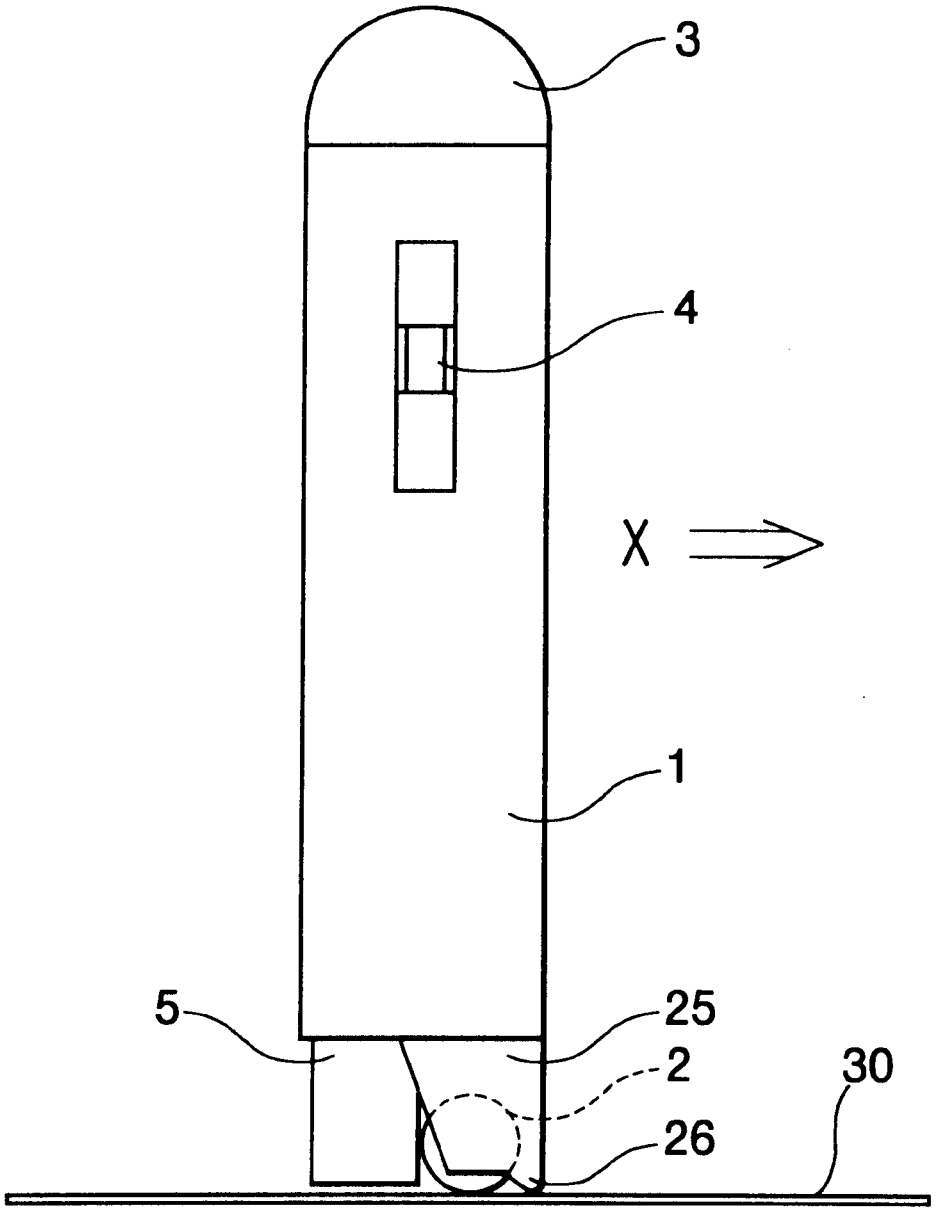
FIG. 1 is a side view showing a manual printing device according to an embodiment of the present invention.

A manual printing device according to a preferred embodiment of the present invention will be described while referring to the accompanying drawings wherein like parts and components are designated by the same reference numerals to avoid duplicating description.

FIG. 1 is an external view showing a manual printing device according to the present embodiment of the present invention. A body 1 of the manual printing device is formed in a cylindrical shape so as to be easy for a user to hold by hand. An interface portion 3 is provided to an upper tip of the body 1. The interface portion 3 is for performing infrared transmission with an external device, such as a computer, to transmit and receive a variety of data, such as print data, between the external device and the manual printing device. Further, a switch 4 for turning a power source 15 on and off and for selecting one of a variety of print modes is provided to the side of the body 1.

A roller 2 is rotatively supported by a frame 25 at a lower tip of the body 1. An ink jet recording head 5, which serves as a recording means, is provided on the lower tip of the body 1 adjacent to the roller 2. A protrusion 26 is formed on the frame 25 from a resin or other material with good sliding characteristics.

In order to print the print data, inputted from an external device for example, a user grasps the body 1 by hand and places it on a medium 30, such as a paper sheet. The user then scans the body 1 in a scanning direction, indicated by an arrow X in FIG. 1, across the surface of the recording medium 30 while maintaining the roller 2 and the protrusion 26 in contact with the upper surface of the recording medium 30. While the user scans the body 1 across the sheet, the print head 5 ejects ink droplets according to the print data so that a predetermined printing pattern can be printed on the surface of the recording medium 30.

During printing, the roller 2 and the protrusion 26 maintain the upright orientation of the body 1 and fix the distance from the surface of the print medium 30 to the ink jet print head 5. In other words, the roller 2 and the protrusion 26 serve, as a support means and the roller 2 and the protrusion 26 both serve as positioning means.

The roller 2 rotates when the user scans the manual printing device over the surface of the recording medium 30. The manual printing device uses rotation of the roller 2 to detect relative position in the scanning direction between the ink jet print head 5 and the surface of the recording medium 30, to ensure that printing is performed at desired positions. In other words, the roller 2 serves as a positional detection means.

Figure 2:
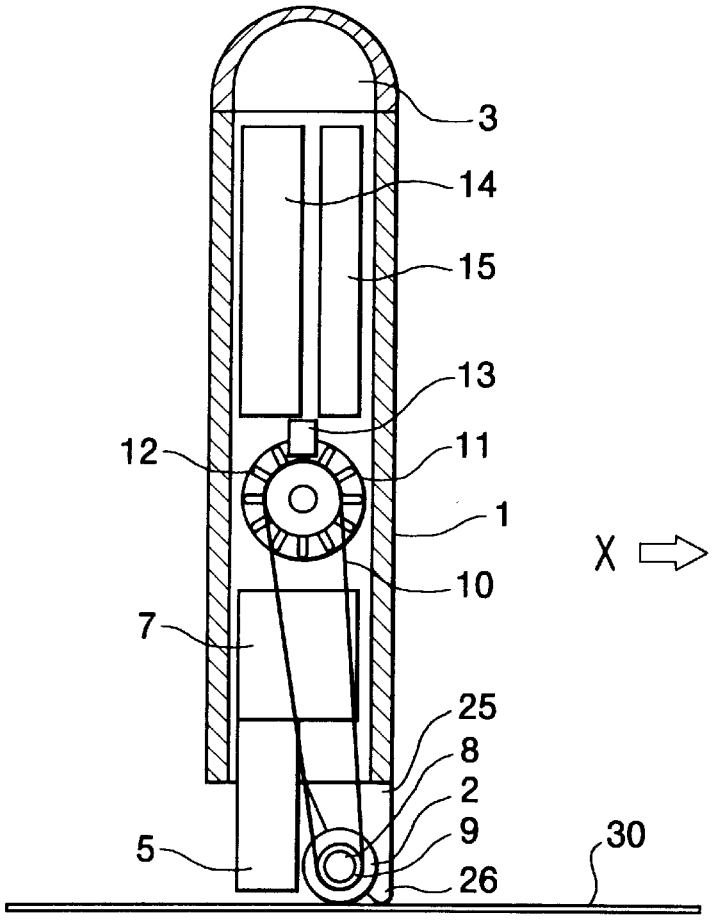
FIG. 2 is a cross-sectional side view showing the manual printing device of FIG. 1.

FIG. 2 is a cross-sectional view showing internal configuration of the manual printing device according to the present embodiment. An explanation will provided for the internal configuration of the manual printing device while referring to FIG. 2.

The roller 2 is supported at the lower tip of the body 1 on a shaft 8 so as to be freely rotatable around the shaft 8. The ink jet print head 5 is disposed to the rear of the roller 2 in regards to the scanning direction X of the manual printing device. An ink tank 7 for supplying ink to the ink jet print head 5 is disposed above the ink jet print head 5.

A pulley 9 is fixed to the shaft 8 of the roller 2 so as to rotate in association with rotation of the roller 2. An encoder 11 having a rotation disk 12 formed with slits around its periphery at a predetermined interval is provided near the center of the body 1. A belt 10 is suspended between the pulley 9 and the rotation disk 12 of the encoder 11 so that rotational force generated by the pulley 9 in association with rotation of the roller 2 is transmitted to the rotation disk 12 of the encoder 11. When the rotation disk 12 is rotated, presence and absence of the slits turn a photointerrupter 13 of the encoder 11 on and off so that the rotational speed of the roller 2, which indicates relative movement in the scanning direction between the ink jet print head 5 and recording medium 30, is converted into an intermittent electric pulse signal. The electric pulse signal is inputted to a control device to be described later. The photointerrupter 13 also detects rotational direction of the roller 2.

A control portion 14 is disposed at the upper end of the body 1. The control portion 14 is for controlling the ink jet print head 5, the electric pulse signal from the photointerrupter 13, and the interface portion 3 provided for receiving print data. The power source 15 for supplying power to a function block (to be described later) is disposed at the side of the control portion 14. The power source 15 includes a small power supply portion, such as a dry cell battery, and a device for stabilizing supply of power.

Figure 3:
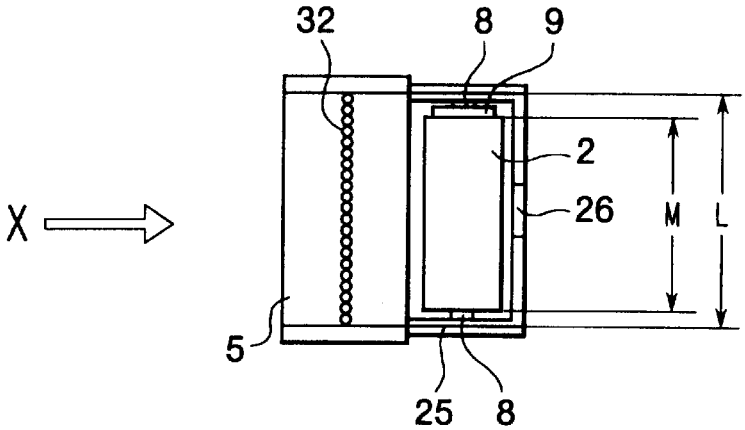
FIG. 3 is an underside view showing relation between a print head and a roller of the manual printing device.

Next, the positional relationship between the ink jet print head 5 and the roller 2 will be described while referring to FIG. 3. FIG. 3 shows the lower surface of the body 1, that is, as viewed from the recording medium 30 on which the manual printing device is placed to print. A plurality of print nozzles 32 are aligned along a nozzle surface of the ink jet print head 5 to a width L extending in a direction perpendicular to the scanning direction X. The roller 2 is positioned in front of the ink jet print head 5 with respect to the scanning direction X. The roller 2 contacts the recording medium 30 at a portion having a width M, which is within the region of the width L of the line of nozzles 32. That is to say, the width M is shorter than the length L, and further, the width M is within the region L. The protrusion 26 is likewise disposed to support this relationship.

Figure 4:
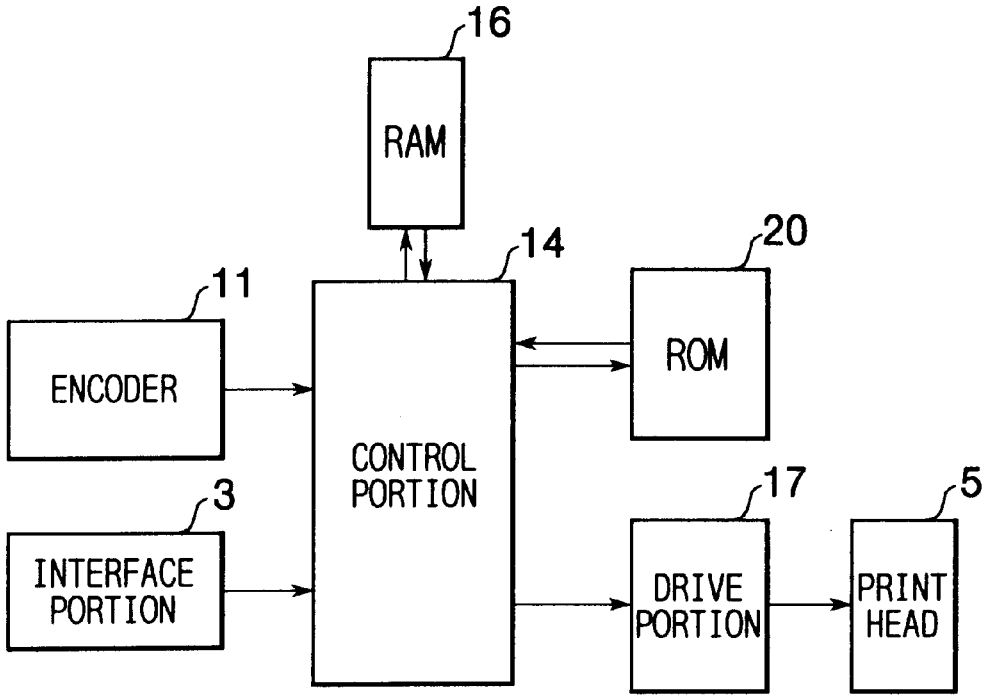
FIG. 4 is a block diagram showing electrical configuration of the manual printing device.

FIG. 4 is a block diagram showing electrical configuration of the manual printing device. The various components shown in FIG. 4 are housed within the body 1 of the manual printing device shown in FIG. 1. The control portion 14, which can be a central processing unit (CPU) is connected to: the interface portion 3; the encoder 11; a ROM 20 storing control programs for controlling a variety of function blocks according to a determined program; a RAM 16 for storing print data inputted via the interface portion 3; and a drive portion 17 for driving the ink jet print head 5. The rotational speed of the encoder 11 is converted into an electric pulse signal and inputted to the control portion 14.

Next, an explanation will be provided for operation of the manual printing device having the above-described configuration. The manual printing device according to the present invention operates following a predetermined program stored in the ROM 20. First, print data is inputted to the interface portion 3 via an infrared signal from an external device. It should be noted that, data input is performed once the control device detects that the switch 4 is set to an input mode. Inputted data is first temporally stored in the RAM 16. When the user manipulates the switch 4 to transmit a start print signal to the control portion 14, the control portion 14 receives the signal, confirms that the print data is stored in the RAM 16, and goes into a print standby condition.

At this time, the control portion 14 determines whether or not the rotation disk 12 of the encoder 11 is rotating. When it determines that the rotation disk 12 is rotating, the control portion 14 controls output of the print data in association with rotational amount of the roller 2. Printing is performed on the surface of the print medium 30 by driving the ink jet print head according to the amount of outputted print data. In this way, output of print data is controlled to match the rotational amount of the roller 2. Accordingly, normal printing of predetermined characters can be performed on the surface of the recording medium 30 regardless of whether the scanning speed of the body 1 across the surface of the recording medium 30 is uniform or not.

Further, the control portion 14 determines the direction in which the user is moving the manual printing device, that is, whether in the scanning direction X or the opposite direction, by determining the rotational direction of the roller 2 via the rotation disk 12. When the user attempts to scan the manual printing device in the direction opposite the scanning direction X, that is, in a direction wherein the roller 2 and the protrusion 26 will follow the ink jet print head 5, the control portion 14 will prevent the ink jet print head 5 from printing characters on the surface of the print medium 30. In this way, the control portion 14 and the encoder 11 serve as a prevention means for preventing the roller 2 and the protrusion 26 from moving over printed areas and smudging the printed characters.

The number of characters in a single printed line is preset. When the predetermined number of characters has been printed, the user separates the body 1 from the recording medium 30 and restarts printing of a second line of characters at a desired position shifted from the first line of characters. At this time, the second line of characters is printed at an optional position desired by the user. Therefore, the space separating the first line of characters from the second row of characters is optionally determined by the user. However, even if the user attempts to print the first line of the characters very close to the second line of the characters, because both the roller 2 and the protrusion 26 are narrower than the maximum printing width of the ink jet print head 5, the roller 2 and the protrusion 26 will not pass over freshly printed characters in the first line. Therefore, printed portions will not be smudged by the roller 2 or the protrusion 26.

While the invention has been described in detail with reference to specific embodiments thereof, it would be apparent to those skilled in the art that various changes and modifications may be made therein without departing from the spirit of the invention, the scope of which is defined by the attached claims.

Figure 5:
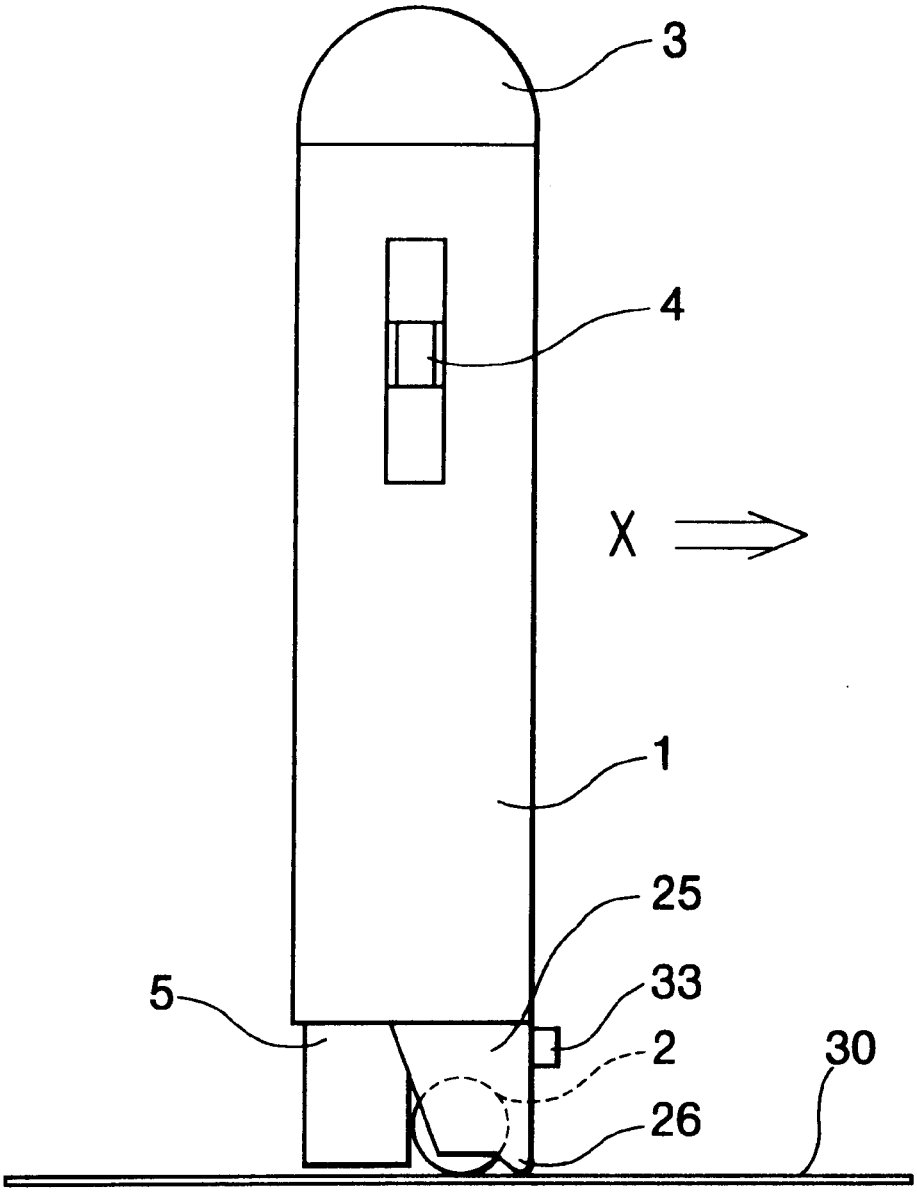
FIG. 5 is a side view showing a manual printing device with a laser doppler detector.
Figure 6:
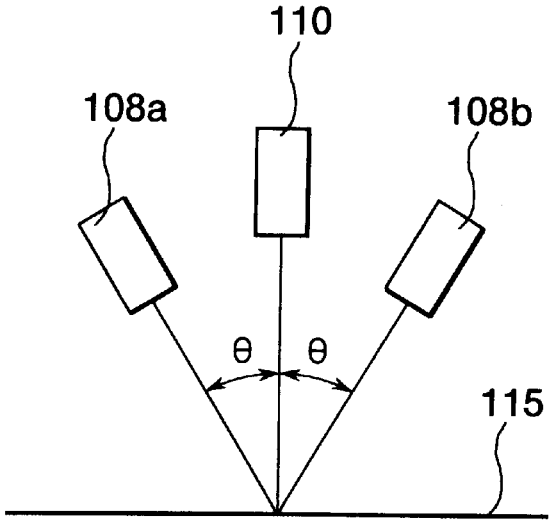
FIG. 6 is a schematic of a laser doppler detector.
Figure 7:
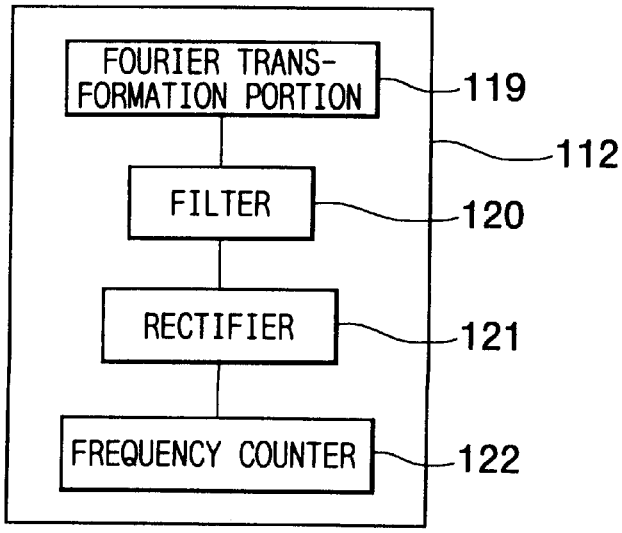
FIG. 7, is a block diagram showing the control portion of a laser doppler detector.

For example, although the above-described embodiment describes the roller 2 as a position detection means for detecting relative speed and position of the recording medium 30 and the ink jet print head 5 by contacting the recording medium 30, the position detection means need not contact the recording medium 30 to perform this task. In FIG. 5, for example, by using a non-contact speed and position detection means, such as a laser doppler speed and position detector 33, the relative speed and position between the manual printing device and the recording medium can be detected. As shown in FIG. 6, the detector includes light emitting portions 108*a*, 108*b* and a light reception portion 110. The light reception portion 110 is disposed perpendicular to the surface of a sheet 115. As shown in FIG. 7, a control portion 112 used with the detector includes: a rectifier 121; fourier transformation portion 119, filter 120 and a frequency counter 122.

To optically measure relative movement between the detector and the sheet 115, as shown in FIG. 6, light emitting potions 108*a*, 108*b* emit laser light at angles θ from a line perpendicular to the surface of the sheet 115. Roughness and other light scattering sources on the surface of the sheet 115 scatters the light. The light reception portion 110 detects the scattered light. A Doppler beat signal, which indicates intensity changes caused by the light scattering sources on the sheet 115, is outputted as a result. The filter 120 filters out the low frequency portion of the Doppler beat signal. The rectifier 121 clips the resultant signal and the frequency counter 122 determines it frequency. A Doppler beat frequency change Δf according to light scattering of the surface of the sheet 115 is obtained as a result. Relative movement and speed between the printer 101 and the sheet 115 can be determined based on further, the body of the manual printing device can be supported in other ways than by the roller 2 and the protrusion 26. For example, a roller not connected to a detection device such as the encoder can be provided for supporting the manual printing device. Alternatively, the protrusion 26 by itself or another similar protrusion 26 formed from a resin or a similar material with good sliding characteristics would be sufficient for supporting the manual printing device.

What is claimed is:

1. A manual ink jet printing device comprising:

an ink jet print head having a maximum printing width on a surface of a recording medium, printing occurring on the surface of the recording medium when the manual ink jet printing device is manually scanned in a scanning direction over the recording medium; and a positioner, provided in front of the ink jet print head with respect to the scanning direction and provided within the maximum printing width of the ink jet print head, that positions the ink jet print head with respect to the surface of the recording medium by contacting the surface of the recording medium, the positioner contacting the recording medium at a width in a direction orthogonal with the scanning direction, the width being narrower than and entirely within the maximum printing width of the ink jet print head.

2. A manual ink jet printing device as claimed in claim 1, wherein the positioner includes a position detector that detects relative position in the scanning direction between the recording medium and the ink jet print head.

3. A manual ink jet printing device as claimed in claim 2, wherein the position detector includes a roller that rotates over the surface of the recording medium to detect relative position between the recording medium and the ink jet print head.

4. A manual ink jet printing device as claimed in claim 1, wherein the positioner includes a support that maintains a predetermined posture of the manual ink jet printing device with respect to the surface of the recording medium.

5. A manual ink jet printing device as claimed in claim 4, wherein the positioner includes a protrusion portion that contacts the recording medium, the roller and the protrusion portion serving as the support.

6. A manual ink jet printing device as claimed in claim 2, wherein the position detector is a laser doppler speed and position detector.

7. A manual ink jet printing device as claimed in claim 1, further comprising a body housing the ink jet print head, wherein the positioner includes a support that maintains a predetermined posture of the body with respect to the surface of the recording medium.

8. A manual ink jet printing device as claimed in claim 1, further comprising a control system that stops printing operations of the ink jet print head when the ink jet print head is scanned in another direction different from the scanning direction.

9. A manual ink jet printing device as claimed in claim 8, the control system including an encoder connected to rotate in association with rotation of the roller.

10. A manual printing device as claimed in claim 8, wherein the another direction is opposite the scanning direction.

11. A manual ink jet printing device as claimed in claim 1, wherein the ink jet print head has a printing array extending to the maximum printing width in a widthwise direction perpendicular to the scanning direction; and the positioner is disposed within the maximum printing width of the printing array with respect to the widthwise direction.

12. A manual ink jet printing device as claimed in claim 2, further comprising a control system that stops printing operations of the ink jet print head when the ink jet print head is scanned in another direction different from the scanning direction.

13. A manual ink jet printing device as claimed in claim 5, wherein the roller extends to an axial length in an axial direction, the protrusion portion contacting the recording medium at a width extending in the axial direction, the width being not greater than the axial length of the roller.

14. A manual ink jet printing device as claimed in claim 11, wherein the maximum printing width of the printing array is substantially the same as the width of the print head extending in a direction perpendicular to the scanning direction.

15. A manual ink jet printing device comprising:

an ink jet print head having a maximum printing width on a surface of a recording medium, printing occurring on the surface of the recording medium when the manual ink jet printing device is manually scanned in a scanning direction over the recording medium;

a positioner provided in front of the ink jet print head with respect to the scanning direction that positions the ink jet print head with respect to the surface of the recording medium by contacting the surface of the recording medium, the positioner contacting the recording medium at a width in a direction orthogonal with the scanning direction, the width being within the maximum printing width of the ink jet print head; and a control system that stops printing operations of the ink jet print head while the ink jet print head is being scanned in another direction different from the scanning direction, the control system comprising a detector that detects the scanning direction and a scanning amount of the ink jet print head, and a controller that controls printing operation of the ink jet print head according to the detected scanning amount while the detected scanning direction indicates that the ink jet print head is scanned in the scanning direction, and controls the ink jet print head to stop printing irrespective of the detected scanning amount when the detected scanning direction indicates that the ink jet print head is being scanned in an other direction to thereby stop the printing operation while allowing movement in the other direction.

16. A manual ink jet printing device as claimed in claim 15, wherein the positioner includes a roller that rotates when the manual ink jet printing device is scanned across the recording medium; and wherein the control system includes an encoder connected to rotate in association with rotation of the roller.

17. A manual ink jet printing device comprising:

an elongated body that is manually grasped by a user and having an upper tip and a lower tip opposite the upper tip, the lower tip confronting a recording medium when the body is oriented with respect to the recording medium to print on the recording medium;

an ink jet print head disposed at the lower tip having a maximum printing width on a surface of the recording medium, printing occurring on the surface of the recording medium when the manual ink jet printing device is manually scanned in a scanning direction over the recording medium;

a frame disposed at the lower tip and, with respect to the scanning direction, in front of the ink jet print head;

a roller, rotatably supported on the frame, that rotates across the surface of the recording medium when the manual ink jet printing device is scanned in the scanning direction over the recording medium; and a protrusion extending from the frame and, when the body is oriented to print on the recording medium, into contact with the recording medium so as to maintain a predetermined distance between the ink jet print head and the recording medium, wherein the roller and the protrusion are positioned in front of the ink jet print head with respect to the scanning direction and wherein the roller and the protrusion contact the recording medium at a width narrower than and entirely within the maximum printing width of the ink jet print head.

18. The manual ink jet printing device of claim 17, further comprising an encoder that detects movement of the manual ink jet printing device in another direction different from the scanning direction and further comprising a control unit that stops the ink jet print head from printing when the encoder detects movement in the another direction.

19. The manual ink jet printing device of claim 18, wherein the encoder rotates in association with the roller and detects relative position in the scanning direction between the ink jet print head and the recording medium.

20. The manual ink jet printing device of claim 19, wherein the protrusion also maintains a predetermined upright orientation of the body.

21. The manual ink jet printing device of claim 17, further comprising a position detector supported on the frame that detects relative position in the scanning direction between the recording medium and the ink jet print head.

* * * * *